US007443111B2

(12) United States Patent
Jang et al.

(10) Patent No.: US 7,443,111 B2
(45) Date of Patent: Oct. 28, 2008

(54) LIQUID CRYSTAL DISPLAY BACKLIGHT INVERTER

(75) Inventors: Yu Jin Jang, Gyunggi-do (KR); Byoung Own Min, Gyunggi-do (KR); Sang Cheol Shin, Gyunggi-do (KR); Jung Chul Gong, Seoul (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 0 days.

(21) Appl. No.: 11/812,554

(22) Filed: Jun. 20, 2007

(65) Prior Publication Data

US 2007/0290722 A1 Dec. 20, 2007

(30) Foreign Application Priority Data

Jun. 20, 2006 (KR) ..... 10-2006-0055396

(51) Int. Cl.
*H05B 37/02* (2006.01)
*G09G 3/38* (2006.01)

(52) U.S. Cl. ..... 315/291; 315/299; 315/308; 315/362; 345/102

(58) Field of Classification Search ..... 315/209 R, 315/224, 225, 226, 246, 250, 291, 299, 307, 315/308, 362; 345/102, 87, 94
See application file for complete search history.

(56) References Cited

U.S. PATENT DOCUMENTS

| | | | | |
|---|---|---|---|---|
| 5,939,840 | A * | 8/1999 | Nakagawa et al. | 315/307 |
| 6,114,814 | A * | 9/2000 | Shannon et al. | 315/219 |
| 6,198,198 | B1 * | 3/2001 | Fujimura et al. | 310/316.01 |
| 7,095,635 | B2 * | 8/2006 | Fukumoto | 363/21.09 |
| 7,224,196 | B2 * | 5/2007 | Fukumoto | 327/131 |
| 7,236,375 | B2 * | 6/2007 | Fukumoto et al. | 363/15 |
| 7,323,832 | B2 * | 1/2008 | Fukumoto | 315/308 |
| 2005/0140637 | A1 * | 6/2005 | Yi | 345/98 |
| 2005/0243580 | A1 * | 11/2005 | Lyle, Jr. | 363/16 |

* cited by examiner

*Primary Examiner*—Thuy Vinh Tran
(74) *Attorney, Agent, or Firm*—McDermott Will & Emery LLP

(57) ABSTRACT

A liquid crystal display backlight inverter including a first error amplifying unit receiving and comparing a first detection voltage corresponding to a current flowing through a lamp with a first preset reference voltage and outputting a first error voltage corresponding to an error therebetween; a second error amplifying unit receiving and comparing a second detection voltage corresponding to a voltage applied to the lamp with a second preset reference voltage and outputting a second error voltage corresponding to an error therebetween; a feedback selector selecting one of the outputs of the first and second error amplifying unit according to an error between the second detection voltage and a third preset reference voltage; and a lamp control pulse generator generating a pulse signal having a duty controlled according to one of the first error voltage and second error voltage.

6 Claims, 2 Drawing Sheets

LIQUID CRYSTAL DISPLAY BACKLIGHT INVERTER

CLAIM OF PRIORITY

This application claims the benefit of Korean Patent Application No. 2006-55396 filed on Jun. 20, 2006, in the Korean Intellectual Property Office, the disclosure of which is incorporated herein by reference.

BACKGROUND OF THE INVENTION

1. Field of the Invention

The present invention relates to an inverter for driving a lamp of a liquid crystal display (LCD) backlight, more particularly, capable of protecting itself from an overvoltage which, if applied, may damage the lamp or shorten the useful life thereof.

2. Description of the Related Art

In general, a liquid crystal display (LCD) does not generate light on its own, therefore requiring a backlight for irradiating light onto an LCD panel. Until now, a large LCD backlight has mainly employed a cold cathode fluorescent lamp (CCFL) and also includes an inverter for driving the lamp. Notably, it is of great importance to maintain uniform brightness of the lamp of the LCD backlight. To this end, the inverter employs a circuit for feeding back a current of the lamp and keeping the current uniform. Also, the inverter employs an overvoltage protection circuit for protecting the lamp and the inverter circuit in a case where an excessive voltage is applied to the lamp.

FIG. 1 is a circuit diagram illustrating a conventional LCD backlight inverter including a lamp current feedback circuit and an overvoltage protection circuit.

As shown in FIG. 1, the conventional LCD backlight inverter includes an error amplifying unit 11 and a lamp control pulse generator 12. The error amplifying unit 11 receives a voltage corresponding to a current from the lamp (not shown) as a feedback and compares the fed back voltage with a preset first reference voltage Vref1 and outputs an error voltage corresponding to an error therebetween. The lamp control pulse generator 12 outputs a pulse signal having a duty controlled according to an output voltage of the error amplifying unit 11. In addition, the conventional LCD backlight inverter includes an overvoltage protector 13 which receives a voltage corresponding to a voltage applied to the lamp (not shown) as a feedback, compares the fed back voltage with a preset second reference voltage Vref2 and outputs an overvoltage protection signal 13 when the lamp current is greater than the second reference voltage Vref2.

The error amplifying unit 11 includes an error amplifier 112 and a capacitor 113. The error amplifier 112 receives the fed back voltage corresponding to the lamp current through an inverse input terminal and receives the first reference voltage Vref1 through a non-inverse input terminal. The capacitor 113 is connected between the inverse input terminal and an output terminal of the error amplifier 112. Also, the lamp control pulse generator 12 includes a triangle wave oscillator 121 and a first comparator 122. The triangle wave oscillator 121 generates a triangle wave with a predetermined frequency. The first comparator 122 compares the triangle wave generated from the triangle wave oscillator 121 with an output of the error amplifying unit 11 and generates a pulse signal having a duty determined. Moreover, the overvoltage protector 13 includes a second comparator 132 comparing the fed back voltage corresponding to the voltage applied to the lamp with the second preset reference voltage Vref2.

In the conventional LCD backlight inverter having the circuit structure as described above, the error amplifying unit 11 controls the fed back voltage corresponding to the lamp current to be equal to the first reference voltage Vref1. In turn, the lamp control pulse generator 12 generates a pulse signal having a duty determined, thereby controlling the current supplied to the lamp to be uniform. Furthermore, when an overvoltage is applied, that is, the lamp is open, the overvoltage protector 13 determines whether the overvoltage is applied and outputs the overvoltage protection signal which interrupts the current supplied to the lamp.

In the conventional LCD backlight inverter capable of protecting itself from the overvoltage as described above, even in a case where an excessive voltage is applied to the lamp, a pulse signal for controlling the lamp is provided to the lamp through the error amplifying unit 11 and the lamp control pulse generator 12, as in a normal condition. Generally, the lamp has a voltage specification required in an abnormal condition such as an open lamp, which is referred to as an open voltage. That is, to greatly extend the useful life of the lamp, the lamp should be applied with the open voltage, i.e., the voltage specification of the lamp in an open lamp condition or in a case where the overvoltage is applied. This accordingly prevents decline in the useful life of the lamp. However, as described above, in the conventional LCD backlight inverter, when the overvoltage is applied, pulse control is performed as in a normal condition until the current supplied to the lamp is completely interrupted and thus the open voltage may not be applied. Therefore, in the conventional LCD backlight inverter, the lamp may be ruined or reduced in useful life when the overvoltage is applied.

SUMMARY OF THE INVENTION

An aspect of the present invention provides a liquid crystal display (LCD) backlight inverter in which an open voltage is applied to a lamp until a current supplied to the lamp is interrupted in a case where the lamp is open or an overvoltage is applied, thereby preventing the lamp from being damaged, or shortened in useful life thereof.

According to an aspect of the invention, there is provided a liquid crystal display backlight inverter including a first error amplifying unit receiving and comparing a first detection voltage corresponding to a current flowing through a lamp with a first preset reference voltage and outputting a first error voltage corresponding to an error therebetween; a second error amplifying unit receiving and comparing a second detection voltage corresponding to a voltage applied to the lamp with a second preset reference voltage and outputting a second error voltage corresponding to an error therebetween; a feedback selector grounding an input terminal of the first error amplifying unit, to which the first detection voltage is inputted, and inputting the second detection voltage to the second error amplifying unit when the second detection voltage is greater than a third preset reference voltage and inputting the first detection voltage to the first error amplifying unit and grounding an input terminal of the second error amplifying unit, to which the second detection voltage is inputted, when the second detection voltage is smaller than the third reference voltage; and a lamp control pulse generator generating a pulse signal having a duty controlled according to one of the first error voltage and second error voltage.

The first error amplifying unit may include a first error amplifier receiving the first detection voltage applied to an inverse input terminal and the first reference voltage applied to a non-inverse input terminal; and a capacitor connected between the inverse input terminal and an output terminal of the first error amplifier.

Likewise, the second error amplifying unit may include a second error amplifier receiving the second detection voltage applied to an inverse input terminal and the second reference voltage applied to a non-inverse input terminal; and a capacitor connected between the inverse input terminal and an output terminal of the second error amplifier.

The feedback selector may include a first comparator comparing the second detection voltage with the third reference voltage and outputting a high signal when the second detection voltage is greater than the third reference voltage; a first switch grounding the input terminal of the first error amplifying unit, to which the first detection voltage is inputted, when the first comparator outputs a high signal; and a second switch grounding the input terminal of the second error amplifying unit, to which the second detection voltage is inputted, when the first comparator outputs a low signal.

The first error amplifying unit may have an infinite resistance at an output terminal when the input terminal of the first error amplifying unit is grounded, and the second error amplifying unit has an infinite resistance at an output terminal when the input terminal of the second error amplifying unit is grounded.

The lamp control pulse generator may include a triangle wave generator generating a triangle wave with a predetermined frequency; and a second comparator comparing one of the first error voltage and second error voltage with the triangle wave outputted from the triangle wave generator and generating the pulse signal having a duty determined according to a comparison result.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Figure 1:
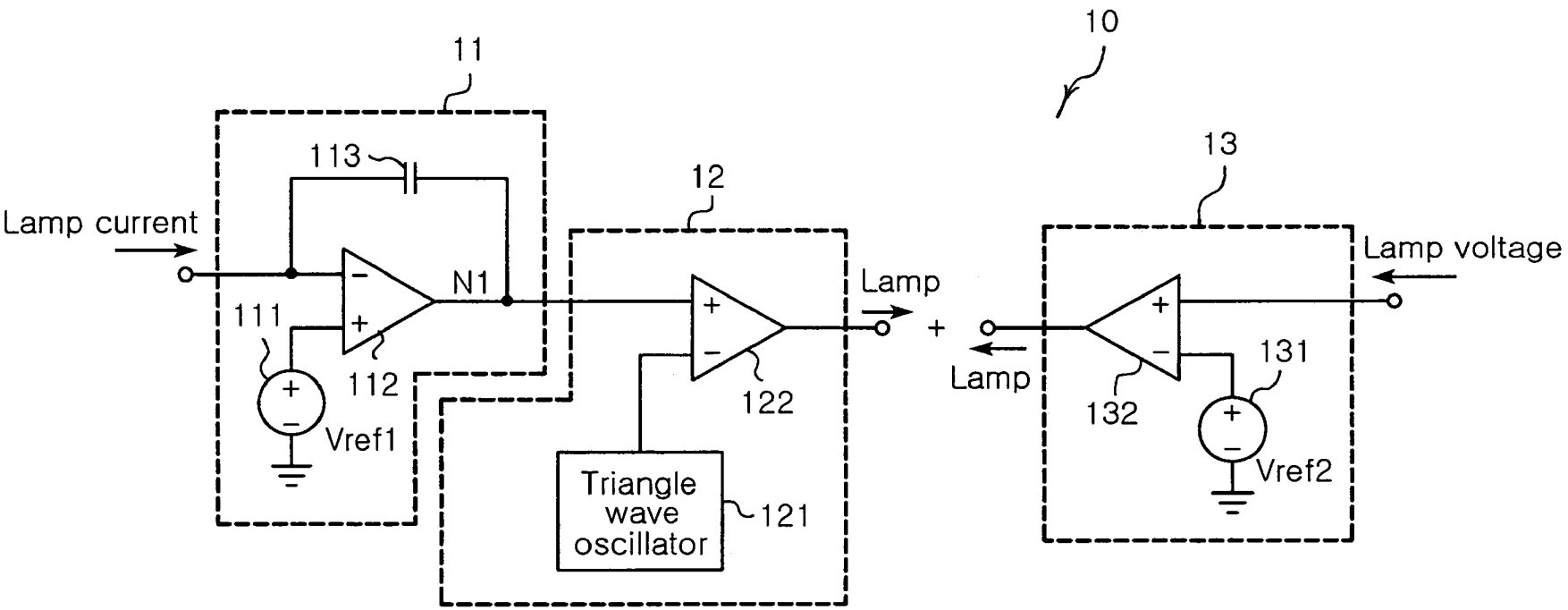
PRIOR ART FIG. 1
FIG. 1 is a circuit diagram illustrating a conventional LCD backlight inverter.

Exemplary embodiments of the present invention will now be described in detail with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference signs are used to designate the same or similar components throughout.

Figure 2:
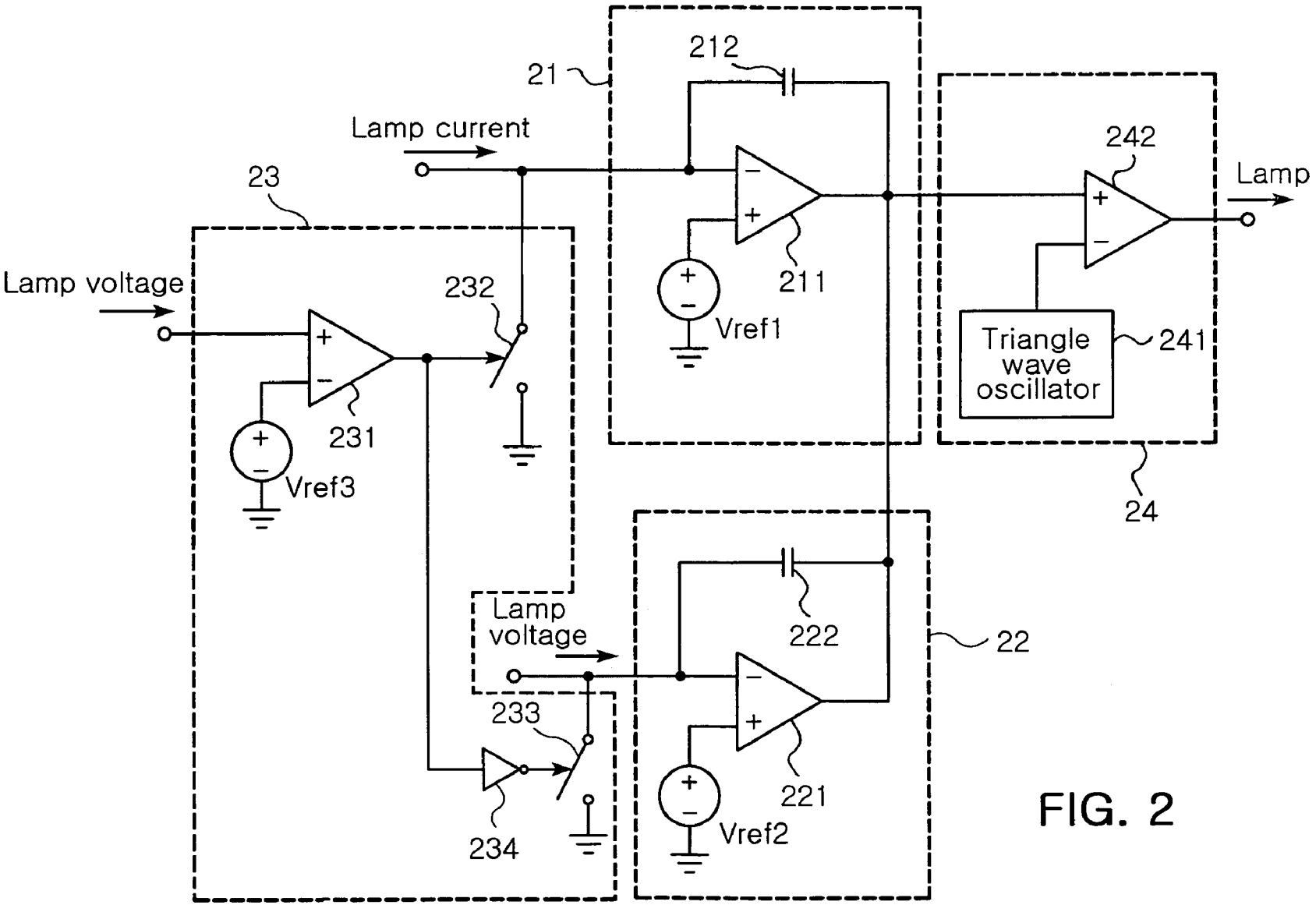
FIG. 2 is a circuit diagram illustrating an LCD backlight inverter according to an exemplary embodiment of the invention.

FIG. 2 is a circuit diagram illustrating a liquid crystal display (LCD) backlight inverter according to an exemplary embodiment of the invention.

Referring to FIG. 2, the LCD backlight inverter according to the present embodiment includes a first error amplifying unit 21, a second error amplifying unit 22, a feed back selector 23 and a lamp control pulse generator 24.

The first error amplifying unit 21 receives and compares a first detection voltage corresponding to a current flowing through a lamp (not shown) with a first preset reference voltage Vref1 and outputs a first error voltage corresponding to an error therebetween. The first detection voltage has a voltage varied according to the current flowing through the lamp (lamp current). For example, the first detection voltage may be set to increase with increase in the lamp current and decrease with decrease in the lamp current. Therefore, the first detection voltage corresponding to the lamp current for driving the lamp may be set substantially equal to the first reference voltage Vref1. That is, the first detection voltage may be controlled to be identical to the first reference voltage Vref1.

The first error amplifying unit 21 may include a first error amplifier 211 and a capacitor 212. The first error amplifier 211 receives the first detection voltage applied to an inverse input terminal and the first reference voltage Vref1 applied to a non-inverse input terminal. The capacitor 212 is connected between the inverse input terminal and an output terminal of the first error amplifier 211.

The second error amplifying unit 22 receives and compares a second detection voltage corresponding to a voltage applied to the lamp (not shown) with a second preset voltage and outputs a second error voltage corresponding to an error therebetween. In a similar manner to the first error amplifying unit 21, the second detection voltage has a voltage varied according to the voltage applied to the lamp (lamp current) That is, the second reference voltage Vref2 is set to an appropriate value and then the second detection voltage is controlled to be identical to the second reference voltage Vref2.

The second error amplifying unit 22 includes a second error amplifier 221 and a capacitor 222. The second error amplifier 221 receives the second detection voltage applied to an inverse input terminal and the second reference voltage Vref2 applied to a non-inverse input terminal. The capacitor 222 is connected between the inverse input terminal and an output terminal of the second error amplifier 221.

The first error amplifying unit 21 controls the lamp current in a normal condition, that is, when the lamp is not open or the overvoltage is not applied thereto. The second error amplifying unit 22 controls the lamp voltage in an abnormal condition, that is, when the lamp is open or the overvoltage is applied thereto. Therefore, the first and second error amplifying units 21 and 22 are selectively operated by the feed back selector 23.

The feed back selector 23 grounds an input terminal of the first error amplifying unit 21, to which the first detection voltage is inputted, and inputs the second detection voltage to the second error amplifying unit 22 when the second detection voltage corresponding to the lamp current is greater than a third preset reference voltage Vref3. On the other hand, the feed back selector 23 inputs the first detection voltage to the first error amplifying unit 21 and grounds an input terminal of the second error amplifying unit 22, to which the second detection voltage is inputted, when the second detection voltage is smaller than the third reference voltage. The third reference voltage Vref is a reference voltage for determining whether the voltage applied to the lamp is normal. In a further description, the second reference voltage Vref2 is a reference voltage for deciding the voltage applied to the lamp to drive the lamp when the lamp is in an abnormal condition. Meanwhile, the third reference voltage Vref3 is a reference voltage for determining whether the voltage applied to the lamp is in a normal or overvoltage condition. Therefore, the feed back selector 23 compares the second detection voltage corresponding to the voltage applied to the lamp with the third reference voltage Vref3, determines that the voltage applied to the lamp is normal when the second detection voltage is smaller than the third reference voltage Vref3 and activates the first error amplifying unit 21 to control the lamp current. On the other hand, the feed back selector 23 determines that the overvoltage is applied to the lamp when the second detection voltage is greater than the third reference voltage Vref3, and activates the second error amplifying unit 22 to control the lamp voltage.

The feedback selector 23 may include a first comparator 231, a first switch 232 and a second switch 233. The first comparator 231 compares the second detection voltage with the third reference voltage ref3 and outputs a high signal when the second detection voltage is greater than the third reference voltage Vref3. The first switch 232 grounds the input terminal of the first error amplifying unit 21, to which the first detection voltage is inputted, when the first comparator 231 outputs a high signal. The second switch 233 grounds the input terminal of the second error amplifying unit 22, to which the second detection voltage is inputted, when the first comparator 231 outputs a low signal.

The lamp control pulse generator 24 generates a pulse signal having a duty controlled according to one of the first error voltage generated by the first error amplifying unit 21 and the second error voltage generated by the second error amplifying unit 22. The lamp current or the lamp voltage is controlled by the pulse signal having a duty controlled according to one of the first error voltage and the second error voltage.

The lamp control pulse generator 24 may include a triangle wave generator 241 and a second comparator 242. The triangle wave generator 24 generates a triangle wave with a predetermined frequency. The second comparator 242 compares one of the first error voltage and second error voltage with the triangle wave outputted from the triangle wave generator and generates a pulse signal having a duty determined according to a comparison result.

As described above, to selectively provide one of the first error voltage and second error voltage to the lamp control pulse generator 24, the first error amplifying unit 21 and the second error amplifying unit 22 each may have an infinite resistance at an output terminal when the input terminal thereof is grounded.

Operation of an LCD backlight inverter will be described in more detail with reference to FIG. 2 according to an exemplary embodiment of the invention.

First, in a normal condition where the overvoltage is not applied to the lamp (not shown), the second detection voltage corresponding to the voltage applied to the lamp is inputted to the first comparator 231 of the feed back selector 23 and compared with the third preset reference voltage Vref3. In a normal condition, the second detection voltage is smaller than the third reference voltage Vref3 and thus the first comparator 231 outputs a low signal. Accordingly, the first switch 232 connected between the input terminal of the first error amplifying unit 21 and a ground is turned to "OFF" (open state). Also, since a high signal is inputted to the second switch 233 connected between the input terminal of the second error amplifying unit 22 and the ground via the inverter 234, it is turned to be "ON" (short-circuit). Therefore, the input terminal of the second error amplifying unit 22 is grounded and the second error amplifying unit 22 has an infinite resistance at the output terminal. That is, since in a normal condition the second error amplifying unit 22 has an infinite resistance at the output terminal, the inverter is driven by the first error signal from the first error amplifying unit 21.

The first error amplifying unit 21 compares the first detection voltage corresponding to the inputted lamp current with the first preset reference voltage Vref1 and outputs the first error signal. The first error signal is inputted to the second comparator 242 of the lamp control pulse generator 24 and compared with the triangle wave with a predetermined frequency outputted from the triangle wave oscillator 241. The second comparator 242 generates the pulse signal having a duty determined according to a comparison result to output to the lamp. For example, when the first detection voltage is greater than the first reference voltage Vref1, a level of the first error signal outputted from the first error amplifying unit 21 is decreased since the first detection voltage is inputted to the inverse input terminal of the first error amplifier 211. In turn, the lamp control pulse generator 24 compares the first error signal inputted to the non-inverse input terminal with the triangle wave with a predetermined frequency outputted from the triangle wave generator 241. A high pulse signal is generated from components of the triangle wave having a smaller value than the first error signal. That is, decrease in a level of the first error signal further narrows a range of the triangle wave having a value smaller than a level of the first error signal, thereby reducing a duty of the pulse signal outputted from the lamp control pulse generator 24. In consequence, the first detection voltage greater than the first reference voltage Vref1 decreases the pulse signal outputted from the lamp control pulse generator 24, thereby reducing the lamp current. On the other hand, the first detection voltage smaller than the first reference voltage Vref1 increases a duty of the pulse signal outputted from the lamp control pulse generator 24 by an opposite operation thereof, thereby increasing the lamp current.

Hereinafter, operation of the LCD backlight inverter will be described, in an abnormal condition where an overvoltage is applied to the lamp (not shown). In an abnormal condition where the overvoltage is applied, the second detection voltage corresponding to the voltage applied to the lamp is inputted to the first comparator 231 of the feed back selector 23 and compared with the third preset reference voltage Vref3. The third reference voltage Vref3 has a value corresponding to a threshold for determining whether a voltage is an overvoltage. In an abnormal condition, the second detection voltage is greater than the third reference voltage Vref3 and thus the first comparator 231 outputs a high signal. Accordingly, the first switch 232 connected between the input terminal of the first error amplifying unit 21 and the ground is turned to "ON" (short-circuit). Also, since a low signal is inputted to the second switch 233 connected between the input terminal of the second error amplifying unit 22 and the ground via the inverter 234, it is turned to be "OFF" (open state). Therefore, the input terminal of the first error amplifying unit 21 is grounded and the first error amplifying unit 21 has an infinite resistance at the output terminal. That is, in an abnormal condition, the first error amplifying unit 21 has an infinite resistance at the output terminal and thus the inverter is driven by the second error signal from the second error amplifying unit 22.

The second error amplifying unit 21 compares the second detection voltage corresponding to the inputted lamp voltage with the second preset reference voltage Vref2 and outputs the second error signal corresponding to an error therebetween. The second reference voltage Vref2 is determined to a value corresponding to the open voltage which should be provided according to a voltage specification when the lamp is open and the overvoltage is applied thereto. Therefore, in a case where the lamp voltage is controlled according to the second reference voltage Vref2, the voltage applied to the lamp is maintained as the open voltage. That is, in a similar manner as the first error amplifying unit 21, the second error signal is inputted to the second comparator 242 of the lamp control pulse generator 24 and compared with the triangle wave with a predetermined frequency outputted from the triangle wave oscillator 24. In turn, the second comparator 242 generates a pulse signal having a duty determined according to a comparison result to output to the lamp. Since the second comparator 242 generates the pulse signal having a duty determined using the second error voltage and the triangle wave in the same manner as generation of the pulse signal having a duty determined by the first error voltage and the triangle wave, further description thereof will be omitted.

As described above, in the conventional LCD backlight inverter, the lamp is controlled as in a normal condition in a case where the lamp is open or the overvoltage is applied thereto, thereby shortening the useful life of the lamp. In contrast, according to the present embodiment, the open voltage, i.e., a voltage specification set for the lamp is applied to the lamp until the lamp is shut down in a case where the lamp is open or the overvoltage is applied thereto. This prevents the lamp from being damaged, or shortened in useful life.

As set forth above, according to exemplary embodiments of the invention, in a case where an overvoltage is applied to a lamp of an LCD backlight, an open voltage, i.e., a voltage specification required by the lamp is applied to the lamp until the lamp is shut down, thereby preventing the lamp from being ruined, or shortened in useful life.

While the present invention has been shown and described in connection with the preferred embodiments, it will be apparent to those skilled in the art that modifications and variations can be made without departing from the spirit and scope of the invention as defined by the appended claims.

What is claimed is:

1. A liquid crystal display backlight inverter comprising:

a first error amplifying unit receiving and comparing a first detection voltage corresponding to a current flowing through a lamp with a first preset reference voltage and outputting a first error voltage corresponding to an error therebetween;

a second error amplifying unit receiving and comparing a second detection voltage corresponding to a voltage applied to the lamp with a second preset reference voltage and outputting a second error voltage corresponding to an error therebetween;

a feedback selector grounding an input terminal of the first error amplifying unit, to which the first detection voltage is inputted, and inputting the second detection voltage to the second error amplifying unit when the second detection voltage is greater than a third preset reference voltage and inputting the first detection voltage to the first error amplifying unit and grounding an input terminal of the second error amplifying unit, to which the second detection voltage is inputted, when the second detection voltage is smaller than the third reference voltage; and a lamp control pulse generator generating a pulse signal having a duty controlled according to one of the first error voltage and second error voltage.

2. The liquid crystal display backlight inverter of claim 1, wherein the first error amplifying unit comprises:

a first error amplifier receiving the first detection voltage applied to an inverse input terminal and the first reference voltage applied to a non-inverse input terminal; and a capacitor connected between the inverse input terminal and an output terminal of the first error amplifier.

3. The liquid crystal display backlight inverter of claim 1, wherein the second error amplifying unit comprises:

a second error amplifier receiving the second detection voltage applied to an inverse input terminal and the second reference voltage applied to a non-inverse input terminal; and a capacitor connected between the inverse input terminal and an output terminal of the second error amplifier.

4. The liquid crystal display backlight inverter of claim 1, wherein the feedback selector comprises:

a first comparator comparing the second detection voltage with the third reference voltage and outputting a high signal when the second detection voltage is greater than the third reference voltage;

a first switch grounding the input terminal of the first error amplifying unit, to which the first detection voltage is inputted, when the first comparator outputs a high signal; and a second switch grounding the input terminal of the second error amplifying unit, to which the second detection voltage is inputted, when the first comparator outputs a low signal.

5. The liquid crystal display backlight inverter of claim 1, wherein the first error amplifying unit has an infinite resistance at an output terminal when the input terminal of the first error amplifying unit is grounded, and the second error amplifying unit has an infinite resistance at an output terminal when the input terminal of the second error amplifying unit is grounded.

6. The liquid crystal display backlight inverter of claim 1, wherein the lamp control pulse generator comprises:

a triangle wave generator generating a triangle wave with a predetermined frequency; and a second comparator comparing one of the first error voltage and second error voltage with the triangle wave outputted from the triangle wave generator and generating the pulse signal having a duty determined according to a comparison result.

* * * * *